United States Patent [19]

Stitzel

[11] 4,011,042

[45] Mar. 8, 1977

[54] OXIDATION OF VAT AND SULFUR DYES

[75] Inventor: Harry Stitzel, Heath Springs, S.C.

[73] Assignee: Olin Corporation, New Haven, Conn.

[22] Filed: Aug. 3, 1971

[21] Appl. No.: 168,734

[52] U.S. Cl. ..... 8/34; 8/37; 8/82

[51] Int. Cl.[2] ..... C09B 9/00; C09B 49/00

[58] Field of Search ..... 8/34, 37, 82, 1 Q

[56] References Cited

UNITED STATES PATENTS

| | | | |
|---|---|---|---|
| 1,905,346 | 4/1933 | Dreyfus et al. | 8/64 |
| 2,265,033 | 12/1944 | Fryer et al. | 8/108 |
| 2,382,188 | 8/1945 | Vincent et al. | 8/34 |
| 2,484,300 | 10/1949 | Mayhew | 8/37 X |
| 3,716,325 | 2/1973 | Aspland | 8/37 |

OTHER PUBLICATIONS

Knecht et al., Principles & Practice of Text. Print., 1952, pp. 589–590.

*Primary Examiner*—P. C. Ives

*Attorney, Agent, or Firm*—F. A. Iskander; T. P. O'Day

[57] ABSTRACT

An improvement is disclosed in the oxidation of reduced vat and sulfur dyes to develop their color and improve its fastness in dyed textiles. The improvement is in using an alkali metal bromite as an oxidizing agent for these dyes.

9 Claims, No Drawings

OXIDATION OF VAT AND SULFUR DYES

This invention relates to the art of dyeing textiles with vat and sulfur dyes. More particularly, the invention relates to an improvement in the oxidation of reduced vat and sulfur dyes to develop their color and improve color fastness in dyed textiles.

Before or after vat and sulfur dyes are applied to a textile, they are usually treated with a reducing agent to solubilize them and enable their easy application to the textile. Then, after application, the dyes are treated with an oxidizing agent to restore them to their original, unreduced form and thereby develop their color and improve its fastness to the textiles.

One of the known oxidizing agents used for this purpose is aqueous sodium chlorite, as taught in U.S. Pat. No. 2,382,188, which issued Aug. 14, 1945 to Vincent et al. However, the use of this material, although generally satisfactory in sme applications, is disadvantageous in several respects. For example, its oxidizing effectiveness usually varies with the chlorite concentration and the particular dye composition. In most applications where aqueous sodium chlorite can be used as a dye oxidant, relatively high concentrations are a prerequisite to achieving complete dye oxidation. Aside from economic considerations, the use of relatively high concentrations of sodium chloride may be corrosive to metal surfaces, and, if accompanied by the release of chlorine dioxide gas, results in toxic environmental conditions. Furthermore, effective use of sodium chlorite solutions in dye oxidation requires the addition of an alkalinity-reducing agent and continuous monitoring and adjustment of the solution pH to keep it acidic. Due to these and other disadvantages, the use of sodium chlorite in the oxidation of vat and sulfur dyes has left much to be desired, and the dyeing industry has long been in search of a similar yet more effective and less troublesome dye oxidizing agent.

The alkali metal bromites have for some time been used in the textile industry as oxidizing agents in de-sizing cellulose fabrics. See, for example, U.S. Pat. No. 3,083,072, issued to Leclerc on Mar. 26, 1963. But the specific utility of these bromites in oxidizing vat and sulfur dyes, with its many advantages, has escaped the skilled dye chemist.

Now it has been found, in accordance with this invention, that the alkali metal bromites can be used to great advantage in the oxidation of dye compositions comprising a reduced vat or sulfur dye. Due to their surprisingly improved oxidizing effectiveness on such dyes, these bromites can be used in low concentration to effect fast oxidation of vat and sulfur dyes. Using these bromites also entails no toxic, hazardous or corrosive conditions.

It is conventional practice, in the art of dyeing textile materials with vat or sulfar dyes, to treat such dyes with a reducing agent. A well-known reducng agent used in the art for this purpose is aqueous sodium hydrosulfite. The main purpose of this reduction step, which may be practiced before or after the dye has been applied to the textile, is to completely solubilize the dye in water and thereby enable its complete penetration, in aqueous solution form, of the textile. Thereafter, the dye is conventionally treated with an oxidizing agent to restore it to its original oxidized form. At least two objects are achieved by this oxidation step. One is to fully develop the color of the dye, since the color or shade of the reduced dye usually differs from that of the unreduced or oxidized dye. The second object is to return the dye to the insoluble state and thereby improve the color fastness of the dyed textile.

By way of illustrating the above-summarized steps used in dyeing with a vat or sulfur dye, a cellulosis fabric is pad-dyed with a vat or sulfur dye of the desired shade. The dye may have been pretreated with a reducing aqueous solution, such as aqueous sodium hydrosulfite, or such treatment may be effected after dyeing by passing the textile at least once through an aqueous reducing bath. Thereafter the textile undergoes several water washings before an oxidizing solution is applied thereto such as by bath-soaking. After the oxidation treatment, the textile is completely washed with water before it is dried or before undergoing further finishing steps.

The method of the present invention, aimed at an improvement in the oxidation step, calls for employing as the oxidizing agent a bromite of an alkali metal. Any of the alkali metal bromites may be employed for this purpose such as sodium bromite, potassium bromite, lithium bromite, rubidium bromite, cesium bromite, and mixtures thereof. However, it is preferred to employ sodium bromite, potassium bromite or mixtures thereof.

The improved process of the invention can be employed in the oxidation of any type of reduced vat or sulfur dyes. For example, the vat dyes can be of the anthraquinone, indigoid or thioindigoid series. Illustrative vat dyes include Vat Orange (CI69025), Vat Green (CI59830), Vat Red (CI73360), Vat Brown (CI69025), Vat Violet (CI60010), Thio Indigo-Red (CI1207), Indanthrene Blue R (CI1106), Vat Yellow (CI65425), and so forth. Illustrative sulfur dyes include Sulfur Yelow (CI53120), Sulfur Red (CI53055), Sulfur Blue (CI53440), Sulfur Green (CI5357), Sulfur Brown (CI53055), Sulfur Black (CI53195), and so forth. It is preferred, however, to utilize the improved method of the invention in the oxidation of vat dyes.

The improved method of the invention may be employed in connection with dyeing all textiles or fibrous materials which are susceptible to coloration with a vat or sulfur dye. Thus the term "textile" as used in the specification and claims herein is intended to include any type of fibrous material, woven fabrics, non-woven fabrics, and so forth, all of which are susceptible to coloration with vat or sulfur dyes. The method of the invention, moreover, is of particular utility in the vat or sulfur dyeing of wholly or partly cellulosic materials such as cotton and cotton-polyester blended fabrics.

Furthermore, the method of the invention is applicable to various types of dyeing methods such as continuous dyeing, jig or piece work dyeing, package dyeing, Beck open vat dyeing, dye-printing, and so forth.

In practicing the method of the invention, any form of an alkali metal bromite may be used to oxidize the vat or sulfur dye. Usually the bromite is used in the form of a solution, the preferred solvent being water. Any suitable concentration of the bromite solution which is effective in achieving oxidation of the dye may be employed. Advantageously, very low concentrations, for example, about 0.001% by weight, may be used. Usually concentrations ranging from about 0.005 to about 5% are employed; and particularly effective oxidation results have been obtained, according to the most preferred embodiment of the invention, using aqueous solutions having an alkali metal bromite concentration ranging from about 0.01 to about 2%.

Although the oxidizing solution of the invention may be employed at any suitable temperature, temperatures ranging from about 75° to about 205° F., and preferably from about 85° to about 200° F., are usually employed. Any conventional means, such as steam coils, may be used to heat the oxidizing solution to the desired temperature.

In oxidizing vat and sulfur dyes according to the teachings of this invention, the oxidizing solution can be used as is, in the desired concentration. However, it is preferred to include in it a small proportion of a basic material such as caustic or soda ash. This is in order to insure an oxidizing solution pH above about 6 and preferably at least about 8. The desired basic material, in an amount calculated to raise the solution pH above the indicated limit, is simply added to the bromite solution or dissolved in water prior to the dissolution of the alkali metal bromite therein. No further additions of toxic material and no monitoring of the pH are usually required thereafter since the pH of the bromite solution is subject to little or no change.

Oxidation of reduced dyes according to the invention can be accomplished by any suitable technique such as passing the dyed textile through a bath of aqueous alkali metal bromite. Surprisingly, a very short soaking time, in many instances one minute or less, is sufficient to achieve oxidation of the dyes thereby developing their color and improving its fastness on textiles. However, long or repeated oxidation treatments may be employed if desired.

After the oxidation step, the dyed textiles are usually subjected to one or more water washings before they are dried or before they are made to undergo further finishing operations.

As noted above, relatively low concentrations of alkali metal bromite solutions are effective in oxidizing reduced vat and sulfur dyes. This is surprising in view of the fact that considerably higher concentrations of alkali metal chlorite would be required to achieve the same oxidizing effect. It is even more surprising that despite the relatively low concentration of bromite required, the oxidation treatment can be effected in a relatively very short time.

There are other practical advantages to the improved process of the invention. Generally the oxidizing effectiveness of the bromite solutions employed herein does not vary substantially with the particular dye or the particular bromite concentration. Thus no burdensome formulation procedure is required in preparing these solutions to suit a particular dye oxidation treatment. The need to periodically or continuously monitor and adjust the pH of these solutions is also done away with by virtue of the fact that the solution pH is not susceptible to substantial change. Furthermore, the use of the bromite solutions entails no corrosive effects on metal surfaces and no toxic or hazardous conditions; and it results in a soft-hand textile having uniform dye absorbency and good dye values.

The following examples are provided to illustrate the invention.

EXAMPLE 1

A cotton-polyester blend fabric was pad-dyed with an aqueous dispersion of a vat dye, Grey 3770. It was then rinsed with water to remove excess dye and oxidized in an aqueous bath containing 500 gallons of water, 32 pounds of 5% aqueous sodium bromite and 2 pounds of sodium carbonate. Thereafter the fabric was washed first with a very dilute acetic acid solution and then with water. Upon drying, the fabric was found to have acquired a uniform, fast grey color. To ascertain that the dye on the fabric has been fully oxidized, the color of the fabric was compared with another fabric dyed in the same manner except for the use of 1% solution of hydrogen peroxide, instead of the sodium bromite solution, in oxidizing the dye. The two fabrics had an identical shade of the color grey throughout.

EXAMPLE 2

An aqueous sulfur dye solution was prepared containing the following ingredients in the indicated proportions:

| Ingredients | Parts by Weight |
|---|---|
| SODYESUL* Liquid Brown FLCF | 18.0 |
| Sodium hydroxide | 0.2 |
| SODYECO* Penetrant SCA (wetting agent) | 0.1 |
| Water | 81.7 |

*Products of Southern Dye

Heated to about 55° C., this solution was used to dye a 100% cotton fabric using a single dye bath dip followed by passing the fabric through the nip of a three-roll padder to squeeze off excess dye solution. The fabric was then rinsed with cold water and oxidized by dipping in a aqueous oxidizing solution maintained at about 60° C. and having a sodium bromite concentration of 0.0375% by weight. The oxidizing solution had been prepared by adding 7.5 grams of a 5% solution of $NaBrO_2$ to 1000 mls. of water rendered alkaline by the dissolution therein of 1 gram of sodium carbonate.

After the oxidation step, the fabric was washed with hot (60° C.) running water and dried by steam pressing. Upon physical examination, the fabric was found to have acquired a fast, uniform dark brown color.

COMPARATIVE TEST 1

The identical procedure of Example 2 was followed except that instead of the sodium bromite oxidizing solution, an aqueous sodium chlorite solution was used having the same concentration and prepared in the same general fashion as the sodium bromite solution of Example 2. The color of the dyed fabric was compared with that of the dyed fabric of Example 2. It was found to have a markedly lighter shade of brown indicating that at the indicated concentration of sodium chlorite, the dye was not completely oxidized.

COMPARATIVE TEST 2

The identical procedure of Example 2 was again followed except that instead of the sodium bromite solution, a sodium chlorite solution was used. The chlorite concentration in this test was 0.075%, that is, double that of the bromite concentration of Example 2. The color of the dyed fabric was compared with that of the dyed fabric of Example 2. Again it was found to have a markedly lighter shade of brown indicating that even at double the concentration of the bromite solution, the chlorite solution concentration was not sufficient to achieve complete oxidation of the dye.

What is claimed is:

1. In a method for dyeing cotton or cellulose-polyester blended textiles with vat or sulfur dyes, comprising the steps of applying a vat or sulfur dye to said textile and subsequently oxidizing said dye by contacting it with an aqueous solution of an oxidizing agent the improvement wherein said aqueous solution comprises 0.005–5 percent by weight sodium bromite and has a pH of at least 6.

2. The method of claim 1 wherein said dye is a vat dye.

3. The method of claim 2 wherein said aqueous solution is at a temperature of 75°–205° F.

4. The method of claim 2 wherein said aqueous solution has 0.01–2.0 percent by weight sodium bromite.

5. The method of claim 1 wherein said dye is a sulfur dye applied in reduced form.

6. The method of claim 4 wherein said aqueous solution is at a temperature of 75°–205° F. when it contacts the reduced sulfur dye.

7. The method of claim 5 wherein said aqueous solution has 0.01–2.0 percent by weight sodium bromite.

8. In a method for dyeing cotton or cotton-polyester textile fibers, comprising the steps of applying at least one vat or sulfur dye in reduced form to said fibers and subsequently oxidizing said dye by contacting it with an aqueous solution of an oxidizing agent, the improvement wherein said aqueous solution of an oxidizing agent comprises, by weight 0.01 to 2% sodium bromite, 0.048 to 0.099% alkali and 95 to 99.99% water, and has pH of at least 8.

9. Method as defined in claim 8, and wherein said aqueous solution of an oxidizing agent is at 75° to 140° F. when it contacts the reduced vat or sulfur dye.

* * * * *